US006772698B2

(12) United States Patent
Ueta et al.

(10) Patent No.: US 6,772,698 B2
(45) Date of Patent: Aug. 10, 2004

(54) ARTICULATED TRAIN HAVING A LOW-FLOOR SECTION

(75) Inventors: Kozo Ueta, Higashi-Osaka (JP); Yasuhiro Azuma, Higashi-Osaka (JP); Keisuke Yokota, Higashi-Osaka (JP); Akihisa Nakazawa, Higashi-Osaka (JP)

(73) Assignee: The Kinki Sharyo Co., Ltd., Osaka (JP)

( * ) Notice: Subject to any disclaimer, the term of this patent is extended or adjusted under 35 U.S.C. 154(b) by 0 days.

(21) Appl. No.: 10/219,846

(22) Filed: Aug. 15, 2002

(65) Prior Publication Data

US 2003/0172835 A1 Sep. 18, 2003

(30) Foreign Application Priority Data

Mar. 14, 2002 (JP) ..... 2002-069896

(51) Int. Cl.[7] ..... B61D 17/00
(52) U.S. Cl. ..... 105/3; 105/1.4; 280/403
(58) Field of Search ..... 105/3, 4.1, 8.1, 105/413, 422, 16.5, 16.7, 16.8, 1.4; 280/403, 911.1; 180/14.1

(56) References Cited

U.S. PATENT DOCUMENTS 4,503,779 A * 3/1985 Chadwick ..... 105/4.1
4,781,123 A * 11/1988 Yoshihara ..... 105/8.1
5,377,597 A * 1/1995 Richter et al. ..... 105/4.1
5,640,910 A * 6/1997 Pouyt et al. ..... 105/168
6,170,682 B1 * 1/2001 Sugimoto et al. ..... 213/75 R

FOREIGN PATENT DOCUMENTS

EP 324 987 A2 * 12/1988
EP 630797 A1 * 12/1994 ..... B61F/5/44
JP 2264809 A * 2/2002

* cited by examiner

*Primary Examiner*—Frantz F. Jules
(74) *Attorney, Agent, or Firm*—Vedder Price Kaufman & Kammholz

(57) ABSTRACT

The invention is structured such that an additional low-floor Vehicle C (intermediate vehicle) is inserted between a high-floor Vehicle A (leading vehicle) and a Vehicle B (trailing vehicle). Between Vehicle A and Vehicle C and between Vehicle B and Vehicle C, un-motorized idling carriages (10) and (24) are used for articulation, respectively. Therefore, the articulation structure that is used between the conventional Vehicle A and Vehicle B can be used also between Vehicle A and Vehicle C, and between Vehicle C and Vehicle B. In other words, the underframe structure of the Vehicle C rear half section is the same as the underframe structure of the Vehicle A rear half section and the underframe structure of Vehicle C top end section is the same as the underframe structure of Vehicle B top end section.

1 Claim, 4 Drawing Sheets

ARTICULATED TRAIN HAVING A LOW-FLOOR SECTION

BACKGROUND OF THE INVENTION

1. Field of the Invention

This invention relates to an articulated low-floor train to provide barrier-free access to the passenger floor, and in particular, relates to an articulated train that provides a low-floor section(s) by utilizing existing high-floor articulated trains.

2. Description of the Related Art

An articulated train, for example, as shown in FIG. 5 is conventionally known to us as a tramcar. This articulated train consists of a front running Vehicle A and a rear running Vehicle B that are articulated by means of a carriage (3). For Vehicle A, a carriage (1) is provided only in the front half section, on the driving cab (4) side, and for Vehicle B, a carriage (2) is provided in the rear half section, on the driving cab (5) side. Thus, Vehicle A and Vehicle B maintain their vehicle bodies horizontally by means of the carriage (3), which is located at the articulation section. In other words, two vehicle bodies balance the entire train horizontally by retaining a form of an articulated train unit. The carriages (1) and (2) located under the front half section of Vehicle A and the rear half section of Vehicle B, respectively, use a motorized two-axle power carriage and the carriage (3) located between Vehicle A and Vehicle B uses an un-motorized idling (auxiliary) carriage (or trailer bogie).

However, the above-mentioned conventional articulated trains are of a high-floor type, having a floor level two or three steps higher than the bottom of the side entrance. Such trains are, therefore, not suitable for users of wheel chairs and baby buggies and physically handicapped people to board and detrain the train.

Hence, a low-floor train has been proposed to facilitate boarding and detraining for those people so that they can directly board from and detrain onto the platform that is constructed on the road surface without climbing up or down the entrance steps. However, conventional low-floor trains require a specific carriage or vehicle body to achieve a low-floor section.

The main purpose of this invention is, in light of the above-mentioned situation, to provide an articulated train that provides barrier-free access to the low-floor section while utilizing existing vehicle bodies and carriages and their articulation structure as much as possible.

SUMMARY OF THE INVENTION

In order to achieve the above-mentioned purpose, the articulated train that has a low-floor section according to the present invention is characterized by a low-floor intermediate vehicle located between two high-floor vehicle bodies and the said intermediate vehicle and the said high-floor vehicles bodies being articulated by means of a carriage, respectively.

Further, the articulated train that has a low-floor section according to the present invention is characterized in, in addition to the above-mentioned structure, that it is applied to existing articulated trains that consists of two high-floor vehicle bodies, front and rear running, articulated by means of a carriage, where a low-floor intermediate vehicle is inserted between the said two high-floor vehicle bodies, front and rear running, and in addition, the intermediate vehicle and each of the front and rear running vehicle bodies are articulated by means of a carriage, on each of which the said high-floor vehicle body is placed, the carriage located on the driving cab side being a motorized power carriage while the carriage located between the intermediate vehicle and each of the front and rear running vehicle bodies being an un-motorized idling carriage.

And then, in addition to the above-mentioned structure, it is preferably an articulated train having a low-floor section, which is characterized in that the underframe structure of the rear half section of the existing front running vehicle body is adopted in the rear half section of the underframe of the intermediate vehicle and the underframe structure of the front half section of the existing rear running vehicle body is adopted in the front half section of the underframe of the intermediate vehicle.

In addition to the above-mentioned structure, it is more preferably an articulated train having a low-floor section, which is characterized in that the distance between the carriages that are furnished at both ends of the intermediate vehicle is the same dimensions as the distance between the adjacent carriages of the existing articulated train, and accordingly, the intermediate vehicle is positioned between the existing front and rear running vehicle bodies with all distances between the adjacent carriages being the same dimensions.

Further, the present invention provides a low-floor intermediate vehicle to be inserted between the existing high-floor vehicle bodies in order to structure an articulated train having a low-floor section as characterized by any of the above-mentioned features.

Or otherwise, the present invention provides an intermediate vehicle to be inserted between vehicle bodies of the existing articulated train consisting of two high-floor vehicle bodies, front and rear running, articulated by means of a carriage, where the said intermediate vehicle is characterized in that it is made into a low-floor vehicle body, and is to be articulated with the existing vehicle bodies by means of an un-motorized idling carriage, where the underframe structure of the rear half section of the existing front running vehicle body is adopted in the rear half section of the underframe of the intermediate vehicle and the underframe structure of the front half section of the existing rear running vehicle body is adopted in the front half section of the underframe of the intermediate vehicle.

Further, the intermediate vehicle used for the articulated train having a low-floor section according to the present invention is interjacent between vehicle bodies of the existing high-floor articulated train, where both ends of the train on the driving cab sides are located on a motorized power carriage while each vehicle body is articulated with another vehicle body by an un-motorized idling carriage, and this intermediate vehicle is characterized in that it is made into a low-floor vehicle body, and an idling carriage to articulate it with the said existing vehicle body is furnished at both ends of the vehicle body, respectively, fore and back, of the intermediate vehicle, and each idling carriage has a bearing, having three bearing rings (races), located horizontally, where the intermediate ring is positioned between the internal ring and the external ring so that this bearing provides a ball bearing between the internal ring and the intermediate ring, and provides another ball bearing between the intermediate ring and the external ring, where the intermediate ring is fixed to the idling carriage, and the bearing of the idling carriage furnished at the one end of the intermediate vehicle has its external ring fixed to the underframe of the existing vehicle body while the internal ring is fixed to the underframe of the intermediate vehicle in such a manner that it can rotate around the shaft laid across the diameter, and the bearing of the idling carriage furnished at the other end of the intermediate vehicle has its external ring fixed to the underframe of the intermediate vehicle while the internal ring is fixed to the underframe of the existing vehicle body in such a manner that it can rotate around the shaft laid across the diameter.

With the articulated train having a low-floor section according to the present invention, it is possible to achieve an articulated train that provides barrier-free access to the low-floor section while utilizing existing vehicle bodies as well as carriages and articulation structures as much as possible.

BRIEF DESCRIPTION OF THE SEVERAL VIEW OF THE DRAWING

DETAILED DESCRIPTION OF THE PREFERRED EMBODIMENTS

The following section describes in more detail an articulated train that has a low-floor section according to the present invention, based on an embodiment.

Figure 1A:
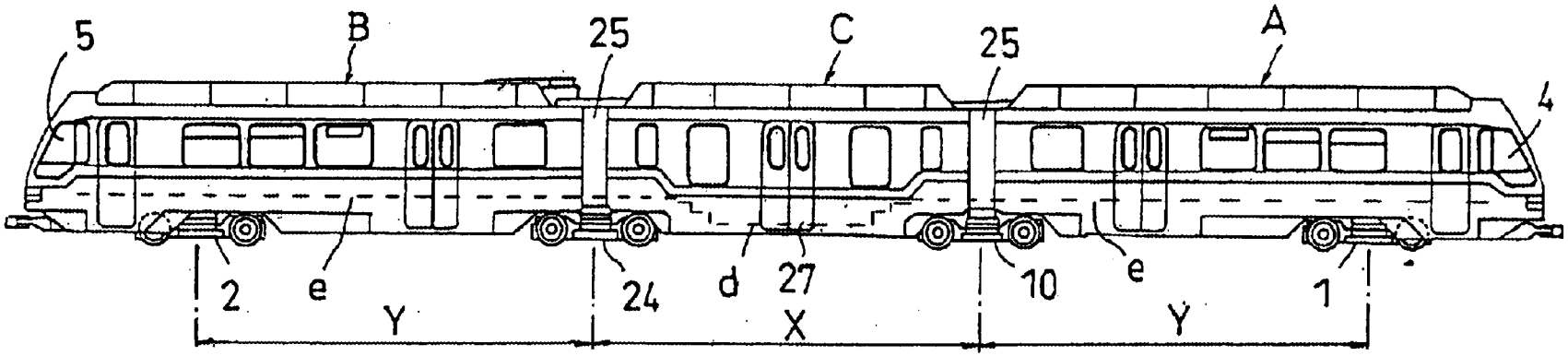
FIG. 1 shows an embodiment of the articulated train that has a low-floor section according to the present invention, where (a) is a side view and (b) is a top view of the train interior.
Figure 1B:
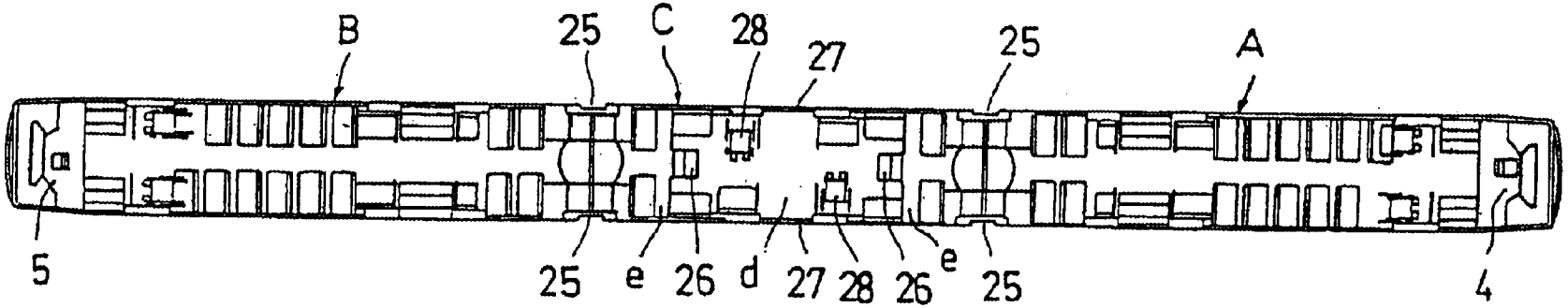

FIG. 1 shows an embodiment of the articulated train according to the present invention, where (a) is a side view and (b) is a top view of the train interior. This train consists of three vehicle bodies with two articulations and is to be used as a tramcar.

Figure 5:
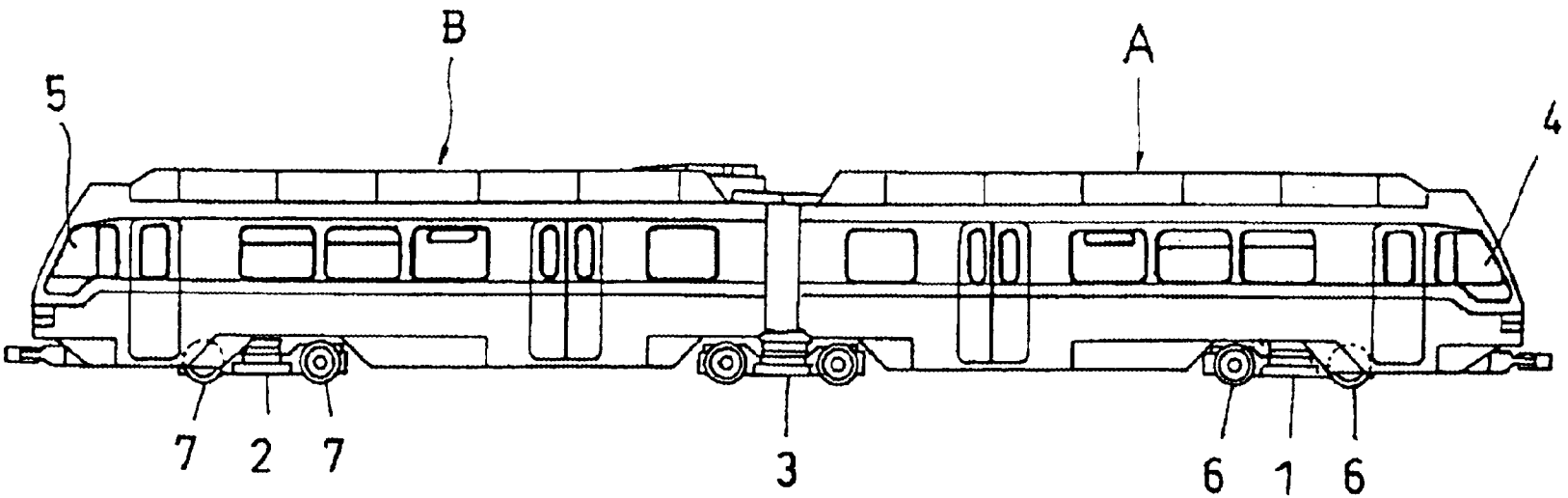
FIG. 5 is a schematic side view to illustrate a typical conventional tramcar.

The articulated train of this embodiment is applied to a conventional high-floor train consisting of two vehicle bodies with one articulation as shown in FIG. 5. In other words, it is structured by inserting an additional low-floor Vehicle C (intermediate vehicle) between a high-floor Vehicle A (leading vehicle) and another Vehicle B (trailing vehicle).

In addition, the conventional articulated train consists of a front running vehicle A and a rear running vehicle B articulated to each other by means of a carriage (3) as shown in FIG. 5. Motorized power carriages are adopted for carriages (1) and (2) to be furnished under the driving cabs (4) and (5) of Vehicles A and B. Each of these power carriages (1) and (2) has two axles furnished with wheels (6) and (7) at both axle ends, left and right, and for these wheels a motor is provided. Further, the bolsters of the power carriages (1) and (2) are coupled with the bolster of the vehicle body so that the carriages (1) and (2) and the vehicle bodies (Vehicles A and B) can be slewed freely by means of the vertically located center pin. On the other hand, an un-motorized idling carriage is adopted for carriage (3) that articulates Vehicle A and Vehicle B.

As shown in FIG. 1, the articulated train of this embodiment consists of Vehicle A and Vehicle B with another Vehicle C inserted in-between. Between Vehicle A and Vehicle C, and between Vehicle B and Vehicle C, un-motorized idling carriages (10) and (24) are used for articulation.

Therefore, between Vehicle A and Vehicle C, and between Vehicle C and Vehicle B, we can use the articulation structure that is already used between the conventional Vehicle A and Vehicle B as shown in FIG. 5. In other words, the underframe structure of the Vehicle C rear half section is the same as the underframe structure of the Vehicle A rear half section and the underframe structure of the Vehicle C front half section is the same as the underframe structure of the Vehicle B front half section.

Figure 2:
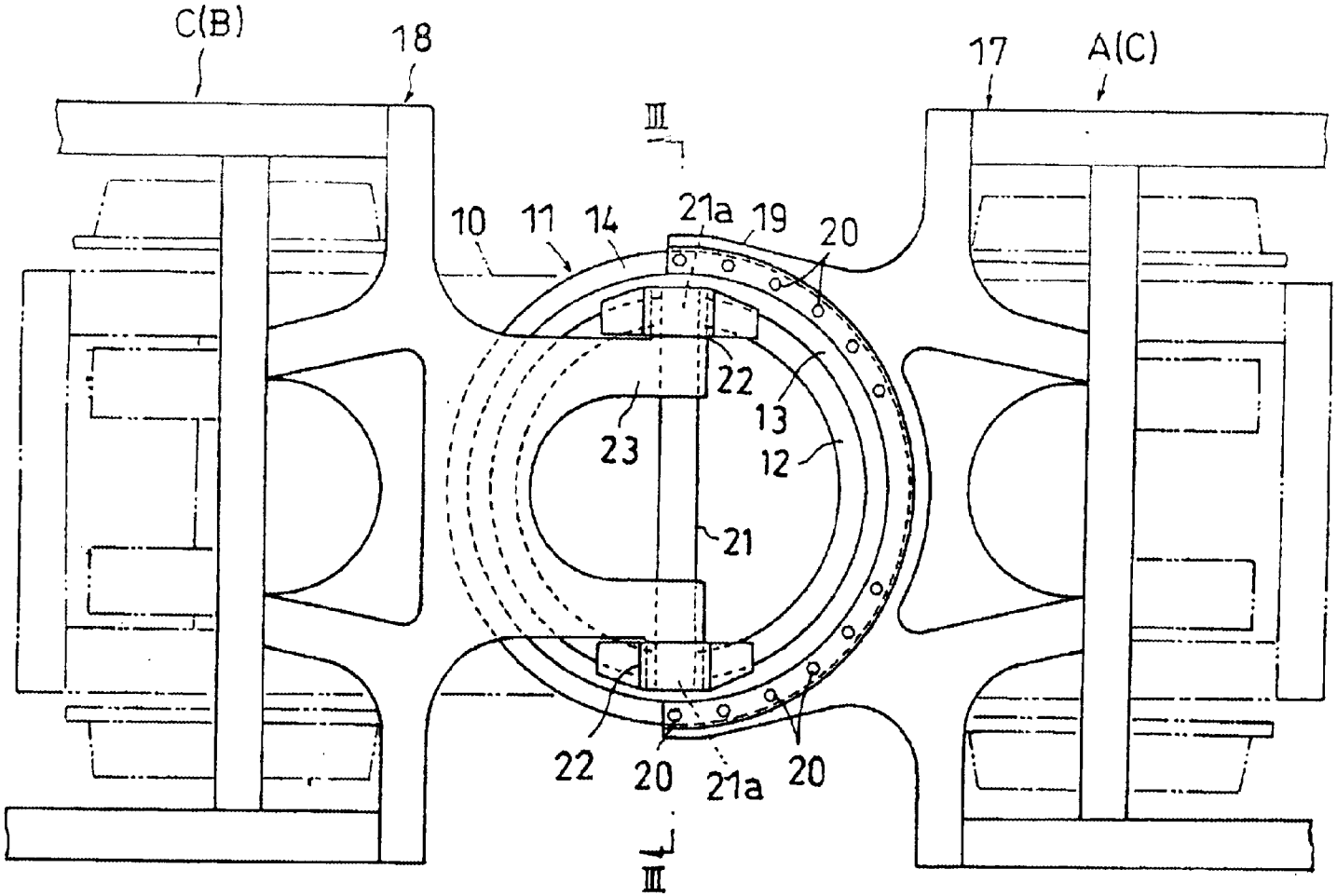
FIG. 2 is a schematic top view to show the underframe articulation structure of the articulated train of FIG. 1.
Figure 3:
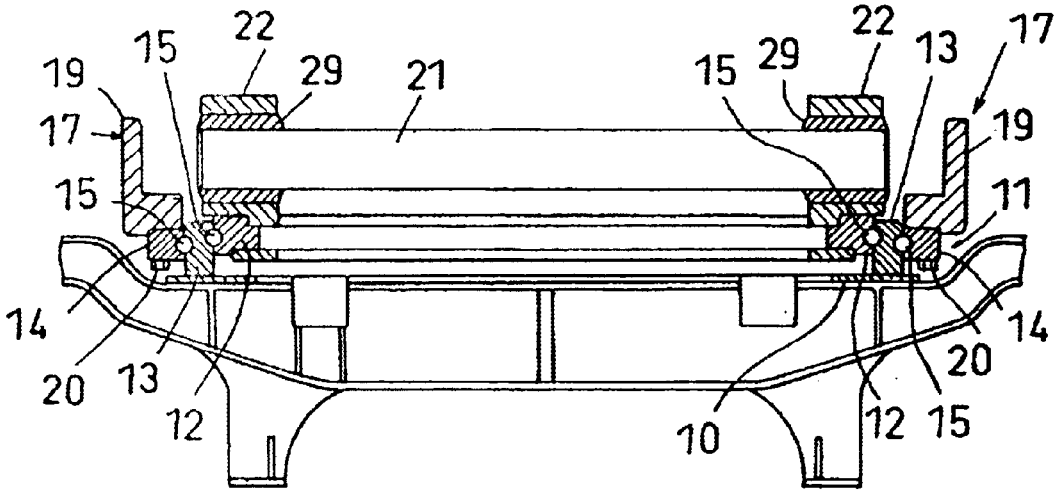
FIG. 3 is a III—III cross-section of FIG. 2.
Figure 4:
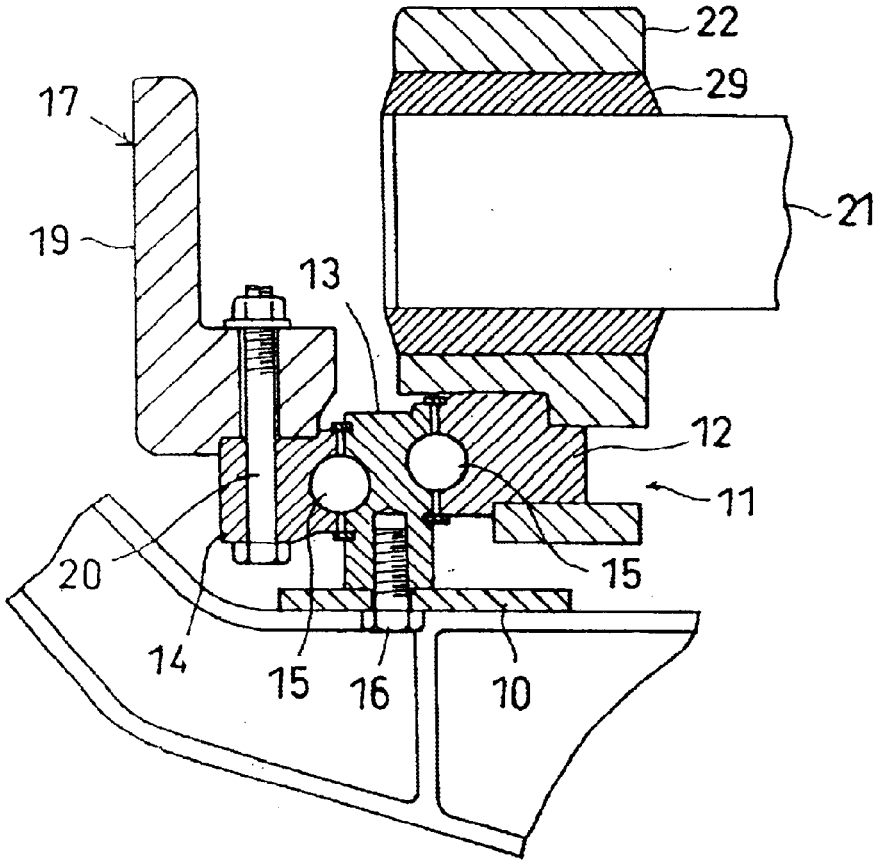
FIG. 4 is a partial enlarged view of FIG. 3.

FIG. 2 is a schematic top view illustrating the articulation structure between Vehicle A and Vehicle C. FIG. 3 is a III—III cross-section of FIG. 2 and FIG. 4 is a partial enlarged view of FIG. 3. In FIGS. 3 and 4, the after-mentioned second articulation arm (23) is omitted for convenience's sake.

The underframe structure of the articulation section of Vehicle C shown on the left of FIG. 2 is the same as the underframe structure of the articulation section of Vehicle B.

As shown in FIG. 2, a bearing (11) is laid horizontally at the center of carriage (10).

This bearing (11) has three bearing rings (races) including an internal ring (12) and an external ring (14) with another intermediate ring (13) positioned between the two rings, where a large number of balls (15) are placed circumferentially between the internal ring (12) and the intermediate ring (13) and between the intermediate ring (13) and the external ring (14), thus providing two ball bearing structures.

As shown in FIG. 4, the intermediate ring (13) is fixed to the carriage (10) with bolts (16).

In this embodiment, as shown in FIG. 2, the underframe (17) of the articulation on the vehicle end of Vehicle A is mounted to the external ring (14), and the underframe (18) of Vehicle C is mounted to the internal ring (12). In this configuration of FIG. 2, the half of the external ring (14) on the Vehicle A side is used as the fixing part to the underframe (17) of the articulation on the vehicle end of Vehicle A and the half of the internal ring (12) on Vehicle C side is used as the mounting part to the underframe (18) of Vehicle C.

To the underframe (17) of the articulation on the vehicle end of Vehicle A, a first articulation arm (19) with a shape of a broadly semicircular arch is furnished with its open part facing to Vehicle C. As shown in FIG. 4, this first articulation arm (19) has a broad L-shaped longitudinal section and it is fixed to the said external ring with bolts and nuts (20) at two or more spots along the circumference.

Further, a shaft (21) is laid across the diameter (in the vehicle body width direction in FIG. 2) of the said internal ring (12). This shaft (21) has both ends held by the bearings (22) and (22) fixed to the internal ring (12). In addition, a rubber bushing (29) is furnished between the shaft (21) and the bearing (22) and thus the rotation in the vertical direction of the shaft (21) in relation to the bearing (22) is lightly restrained.

To the underframe (18) on the Vehicle A side of Vehicle C, a broad U-shaped second articulation arm (23) is furnished with its open part facing to Vehicle A. The said shaft (21) is laid crosswise, penetrating both open ends of this second articulation arm (23), and both of its ends **(21*a*) and (21*a*) are fitted into the said bearing (22)**.

Since the articulation is structured as mentioned above, both Vehicle A and Vehicle C can be slewed in a horizontal plane by means of the bearing (11), and moreover, both Vehicle A and Vehicle C can be rotated vertically around the said shaft (21).

As the previous section described the details of the articulation structure between Vehicle A and Vehicle C, the details of articulation structure between Vehicle C and Vehicle B are the same, except that the notations of Vehicle A and Vehicle C in FIG. 2 should be replaced with Vehicle C and Vehicle B as shown in parentheses, respectively, in the same diagram.

In other words, the said first articulation arm (19) is furnished on the underframe on the Vehicle B side of Vehicle C and the said second articulation arm (23) is furnished on the underframe on the vehicle end articulation side of Vehicle B. Accordingly, Vehicle B and Vehicle C are also articulated by means of the idling carriage (24), similar to Vehicle A and Vehicle C.

Now, as shown in FIG. 1, the distance X between two carriages located at the ends of Vehicle C, which is a low-floor vehicle body, should be preferably the same dimensions as the distance Y between the two carriages located at both ends of Vehicles A and B. This is because a certain inconvenience arises when the train is running on curved rails if the carriage-to-carriage distance is not set to the same dimensions. If the carriage-to-carriage distance between both ends of Vehicle C is set to a longer value for example, Vehicle C runs with its body shifted inside the curve. Setting the carriage-to-carriage distance to the same dimensions can solve this problem of running beyond the train limit when traveling a curve.

Incidentally, at the junction of vehicle bodies, vehicle bodies are articulated not only at the bottom as mentioned above, but they are articulated with an appropriate structure also at their top. Furthermore, the sides (25) of the articulation section are covered with accordion rubber walls.

In this embodiment, Vehicle C has a low-floor section at its center but high-floor sections at both ends, which is the same level as Vehicles A and B. The low-floor area "d" and the high-floor area "e" should be connected with steps (26) to allow passenger to pass through. Vehicle C should be furnished with side entrances (27) in the middle of the longitudinal direction. In addition, areas for wheelchair parking (28) should be furnished next to the side entrances (27).

Conventional trains have high-floor surfaces of a level two or three steps higher than the bottom of the side entrance. Therefore, such trains are not suitable for users of wheelchair sand baby buggies and physically handicapped people to board and detrain the train. However, if an intermediate vehicle having a low-floor section according to the present invention is operated as a tramcar, it provides barrier-free access for wheelchairs, baby buggies, etc., from platforms on road surface without climbing up/down such steps.

Further, conventional low-floor trains require specific carriages to achieve low-floor areas. However, the articulated train that has a low-floor section according to the present invention can utilize the existing conventional carriages and articulation units without modification in order to easily add a low-floor section(s) to high-floor trains that are currently operated.

Further, the articulated train having a low-floor section according to this invention is not limited to the structure of the above-mentioned embodiment, and it can be appropriately modified as necessary.

For example, the above-mentioned embodiment consists of Vehicle A and Vehicle B and one intermediate vehicle (Vehicle C) articulated in-between, however, two or more vehicle bodies of intermediate vehicle of the similar articulation structure may be articulated in tandem.

What is claimed is:

1. An intermediate vehicle to be used in an articulated train having a low-floor section, which is an intermediate vehicle to be interjacent between a first vehicle body and a second vehicle body of a high-floor articulated train, where both ends of the train on the driving cab sides are located on a motorized power carriage, where said intermediate vehicle is characterized in that the intermediate vehicle is made into a low-floor vehicle body; an un-motorized idling carriage to articulate the intermediate vehicle with the first vehicle body and the second vehicle body, fore and back, of the intermediate vehicle; and each idling carriage has a bearing located horizontally, where an intermediate ring is positioned between an internal ring and an external ring, so that this bearing provides a ball bearing between the internal ring and the intermediate ring; and provides another ball bearing between the intermediate ring and the external ring, and the intermediate ring is fixed to the idling carriage; where the bearing of the idling carriage furnished at one end of the intermediate vehicle uses its external ring as the fixing part to the underframe of the first vehicle body while the internal ring is fixed to the underframe of the intermediate vehicle in such a manner that it can rotate around a shaft laid across its diameter; and the bearing of the idling carriage furnished at the other end of the intermediate vehicle has its external ring fixed to the underframe of the intermediate vehicle while the internal ring is fixed to the underframe of the second vehicle body in such a manner that it can rotate around a shaft laid across its diameter.

* * * * *